US005275406A

United States Patent [19]

Smagula

[11] Patent Number: 5,275,406

[45] Date of Patent: Jan. 4, 1994

[54] GOLF PRACTICE DEVICE

[76] Inventor: Emil R. Smagula, P.O. Box 3352, Pompano Beach, Fla. 33072

[21] Appl. No.: 975,517

[22] Filed: Nov. 12, 1992

[51] Int. Cl.[5] ..... A63B 69/36

[52] U.S. Cl. ..... 273/184 B; 273/200 B

[58] Field of Search ..... 273/184

[56] References Cited

U.S. PATENT DOCUMENTS

| | | | |
|---|---|---|---|
| 1,091,985 | 3/1914 | Thomas et al. | 273/197 R |
| 2,017,661 | 10/1935 | Johanson | 273/197 R |
| 3,643,961 | 2/1972 | Schroeder | 273/200 R X |
| 3,981,508 | 9/1976 | Koblick | 273/200 B |
| 4,407,503 | 10/1983 | Nishizawa | 273/197 R |
| 4,741,536 | 5/1988 | Tal et al. | 273/197 R X |

FOREIGN PATENT DOCUMENTS

| | | | |
|---|---|---|---|
| 493661 | 10/1938 | United Kingdom | 273/200 B |

*Primary Examiner*—George J. Marlo

[57] ABSTRACT

The improved golf practice device includes a base (32) having an upright center post (24) and an integrally connected center ground pin (14). The base is adapted to be secured to the ground by a unique center pin with the middle portion of the pin formed integrally into a threaded cylindrical shank (18) disposed within a threaded circular cavity (44) formed in the center of the base with its extended upper portion integrally connected projecting vertically as a center post spindel (24).

Mounted on the center spindel is a cylindrical rotor hub (50) with the rotor having a through vertical cavity (58) and two horizontal cylindrical cavities (60) and (62) diametrically opposed.

The verticle cavity is mounted on the center verticle spindel (24) with the horizontal cavities, diametrically opposed, have attached to each cavity a spoke (56) with golf like balls (52) and (54) attached to the ends of each spoke and with the golf like balls spaced equally apart from the verticle axis of the center spindel the golf like balls are adapted to be struck by a golf club swung by a golfer using the practice device.

A circular cap (39) is secured to the upper end of the spindel to retain the rotor on the center spindel (24).

5 Claims, 5 Drawing Sheets

GOLF PRACTICE DEVICE

BACKGROUND—FIELD OF INVENTION

The present invention relates to an improved golf practice device and, more particularly, to an improved device for permitting golfers to practice their golf swings in relatively restricted or confined areas.

BACKGROUND—DESCRIPTION OF PRIOR ART

The game of golf is a popular sport, and in recent years, more and more people have been playing the game. In order to play golf proficiently, a golfer must develope and maintain a proper swing. One of the problems with playing golf is that normally a golfer has had to go to a golf course or driving range in order to practice a golf swing.

However, a trip to a golf course of driving range is relatively expensive and often may be quite time consuming. Consequently, there has long been a need for an inexpensive, relatively simple device which would permit a golfer to realistically practice a golf swing in a relatively restricted or confined area, such as a yard, a park, or even a recreation room.

In the past, a variety of different devices have been proposed for the purpose of enabling a golfer to practice a swing in a relatively restricted or confined area. Several such devices are disclosed in U.S. Pat. Nos.: Des. 165,196: 88,660: 1,259,933: 1,732,971: 1,857,588: 1,932,049: 1,199,518: 2,832,038: 2,961,241: 3,348,416: 3,444,741: 3,472,075: 3,656,759: 3,830,504: 3,981,508: and, in Japanese Patent No.: 892,665.

OBJECTS AND ADVANTAGES

It is a primary object of my present invention to provide an improved golf practice device which provides realistic practrice for a golfer's golf swing for both tee and fairway shots, which may be readily used by both right and left handed golfers, and, may be used in a relatively restricted or confined area, and, which may be relatively inexpensively manfactured so as to permit successful commercialization.

Thereof, more specifically, my improved golf practice device includes a circular base having a singular upright center post. The center post is comprised of a spindel with its lower section disposed into a unique center pin of a ground spike which is pressed into the ground.

A plurality of minature pegs extend from the underside of the base evenly spaced about the periphery of the base to assist in securing the device in the ground.

A rotor hub with verticle and horizontal cavities diametrically opposed containing a through verticle cavity is mounted on the center post spindel whose lower portion rests on the top surface of the center pin shank and rotates horizontally on its verticle axis while the horizontal cavities rotate horizontally on the radial longitudinal axis perpendicular to the central axis.

The horizontal cavities have attached to each cavity a singular spoke; and, each end of the spoke is attached to a golf like ball with each ball being spaced equally apart from the vertical axis of the center spindel. Upon the golf like ball being struck by a golf club, both balls rotate horizontally and simultaneously about its central axis in a horizontal plane spaced above the plane of the base.

A circular turn knob is secured to the upper most portion of the center spindel with a threaded cavity on the underside of the knob. The knob is attached to the upper end of the spindel to retain the rotating rotor on the spindel.

When a ball is struck by a golf club, either by a right hand hitter, or, a left hand hitter, the rotor assembly will rotate freely in a horizontal rotation with the balls rotating freely such as a cup anemometer rotates freely in the wind.

One of the principal advantages of my improved golf practice device, from, the standpoint of its commercialization, is the substantially all of the components of the device may be made from various materials like molded plastics, forged metals, wood, and the like. In molded plastics, it may reduce the manufacturing cost of the device without any appreciable decrease in strength. In addition, the components may be manufactured so as to have an aesthetically attractive appearance and this, of course, is also an extremely important consideration in connection with the successful marketing of today's leisure time products.

These objects and advantages of my present invention will become apparent from the following description of the preferred embodiment of my invention described in connection with the accompanying drawings.

Figure 1:
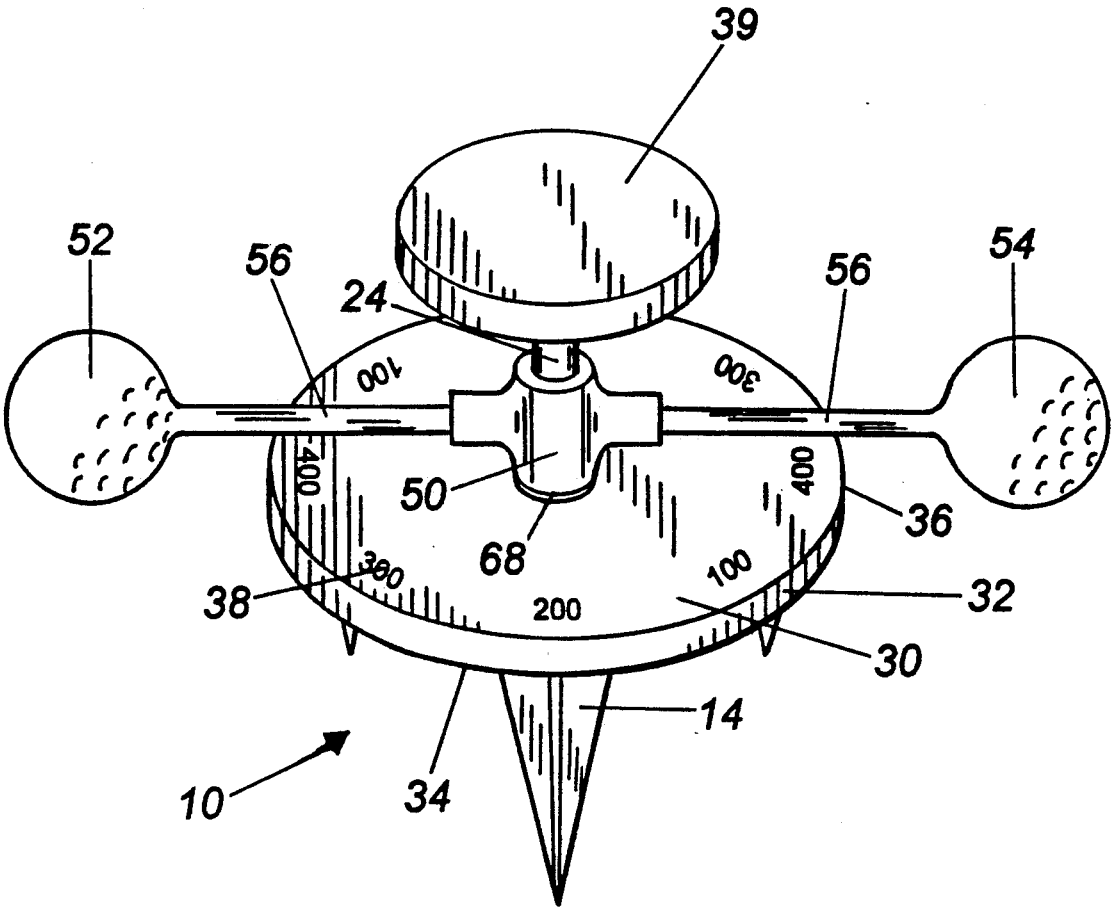
FIG. 1 is a perspective view of an improved golf practice device of the present invention shown secured to the ground.

Throughout the various figures of the drawings, the same reference numerals will be used to designate the same parts of the components. Moreover, when the terms "Right" "Left" "Right End" "Left End" "Lower" and "Upper" are used herein, it is to be understood that these terms have reference to the structure shown in the drawing as it would appear to a person viewing the drawings.

| Reference Numerals in Drawings | |
|---|---|
| 10 Golf device | 12 Ground spike point |
| 14 Ground spike | 16 Shank flange |
| 18 Shank flange threads | 20 Shank flat upper surface |
| 24 Spindel | 26 Spindel threads |
| 28 Cap knob threaded projection | 30 Base upper surface |
| 32 Circular base | 34 Base under surface |
| 36 Base outer ridge | 38 Base upper surface numerals |
| 39 Knob cap top surface | 40 Mini pegs |
| 42 Base center cavity threads | 44 Base center cavity |
| 50 Rotor hub | 52 Golf like ball: right hand hitter |
| 54 Golf like ball: left hand hitter | 56 Spokes |
| 58 Rotor hub cavity | 60 Rotor hub horizontal cavity |
| 62 Rotor hub horizontal cavity | 64 Rotor hub Hi Tee |
| 66 Rotor hub Lo Tee | 68 Rotor shoulder |

DESCRIPTION OF THE PREFERRED EMBODIMENT

Referring now to FIGS. 1 thru 5 an improved golf practice device embodying the principles of my present invention is shown generally at 10 and as noted above, is adapted to be utilized by golfers to practice their swings in relative restricted or confined areas such as a backyard, park, or, even in a recreation room.

As shown in FIGS. 1 thru 4, the golf practice device 10 includes a relatively thin circular base 32 having generally flat parallel upper and lower surfaces 30 and 34 which could be made from plastic, wood, metal, rubber, and the like.

The upper surface 30 of the base 32 includes a generally circular row of numerals 38 spaced radially inwardly from the peripheral edge 36 of the base. The numerals reflect indicated reference points as a suggested guide.

The lower surface 34 is unobstructed and is adapted to be disposed horizontally in direct surface to surface contact with the ground when the device 10 is secured to the ground.

Figure 2:
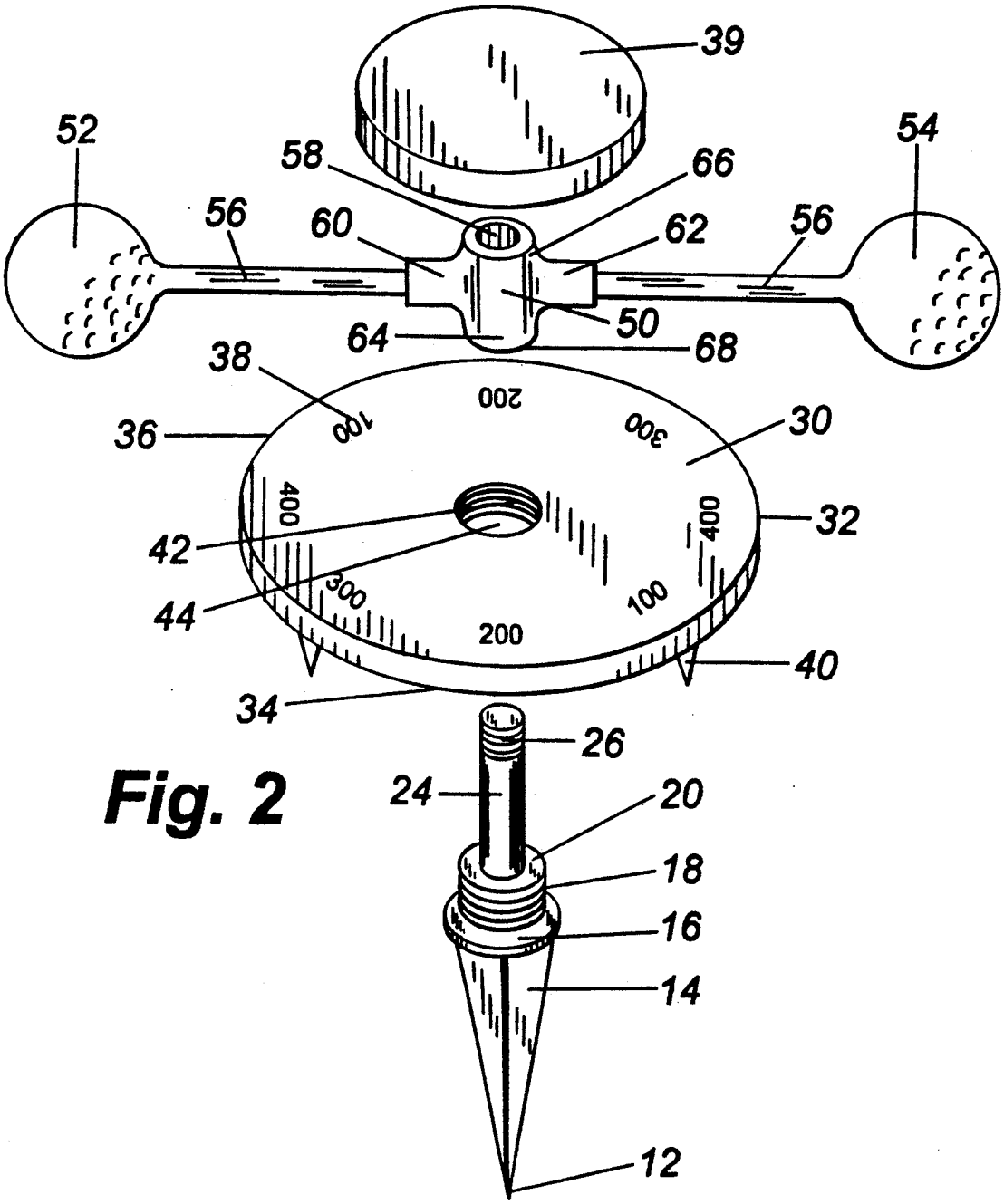
FIG. 2 is an exploded perspective view of the improved golf practice device shown in FIG. 1.
Figure 3:
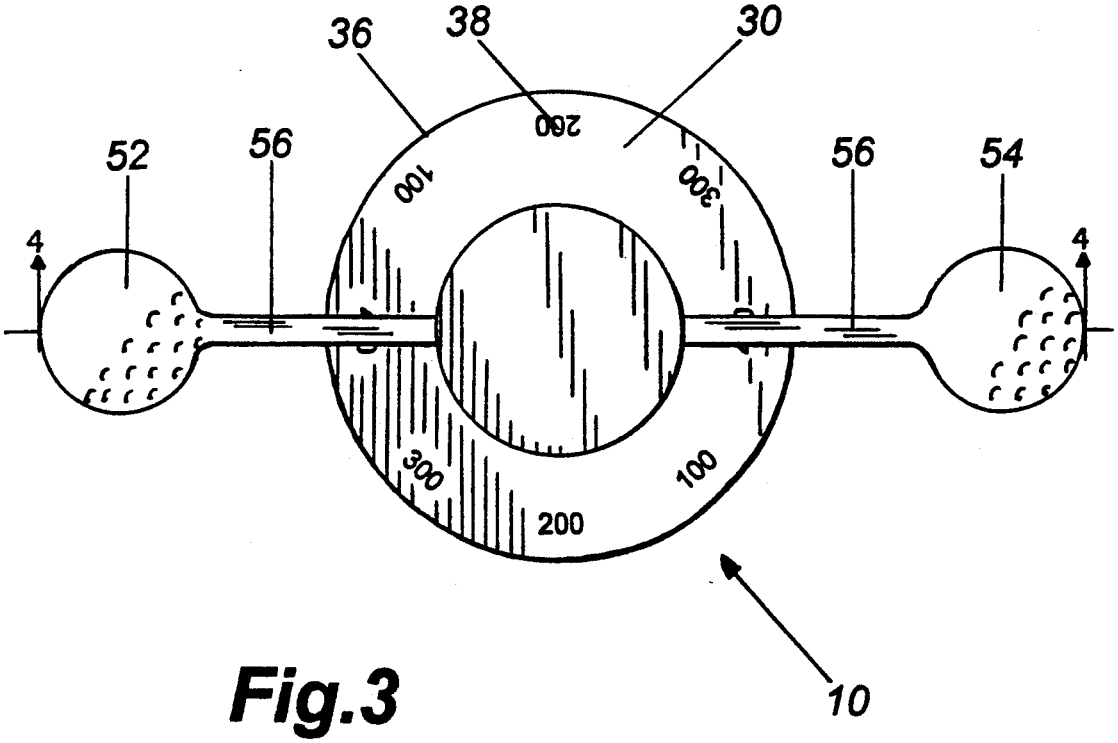
FIG. 3 is a top plan view of the improved golf practice device shown in FIG. 1.

The undersurface of the base 34 also includes a plurality of mini spikes 40 as shown in FIG. 2, spaced equally around the peripheral edge 36 of the lower surface 34 securing the base 32 more securely to the ground.

In the center of the base a generally cylindrical cavity 44 is formed within the center of the base 32 as shown in FIG. 2. The cavity 44 extends from the upper surface of the base 30 to the lower surface of the base 34 whose walls of the cavity are threaded 42 and is adapted to receive the upper middle portion of the center pin 14 whose middle portion is a threaded shank 18 and is adapted to be screwed into the center cavity threaded wall 42 of the base 32.

The mid upper portion of the center pin becomes a vertical cylindrical threaded shank 18 formed integrally with the top surface 20 forming a smooth circular shoulder.

Further formed integrally from the shoulder 20 of the shank 18 is a verticle center spindle 24 formed integrally, extending the spindel approximately two inches, or more, above the shank shoulder 20.

The further upper most end of the spindel 26 contains machine threads to receive the circular turn knob cap 39 which has intergrally formed on the under surface a cylindrical threaded cavity 28 adapted to receive the center verticle spindle 26 top threaded portion.

The center pin ground spike shank 18 is inserted into the base 32 center threaded cavity 44 and is turned clockwise to screw the base firmly to the center pin by allowing the center pin flange 16 to meet flush with the lower surface of the base 34 and become snugly tight against the base.

The center pin ground spike lower portion includes a plurality of verticle blades 14 diametrically opposed and is an integral part of the center pin shank 18.

A rotor 50 with a verticle cavity 58 rotates around the spindle 24 with two horizontal cavities 60 and 62 diametrically opposed.

Attached to each horizontal cavity 60 and 62 are spokes. Each spoke has attached to its ends a golf like ball 52 and 54 and are spaced equally apart from the center of its verticle axis.

The spokes could be made from various materials like glass fibre reinforced nylon and the like and could be attached with glue or screwed into the hub or through a molding process.

The center verticle spindel 24 is inserted into the verticle cylindrical cavity 58 of the the four way verticle and horizontal cylindrical rotor 50 whose horizontal cavities are diametrically opposed.

Figure 4:
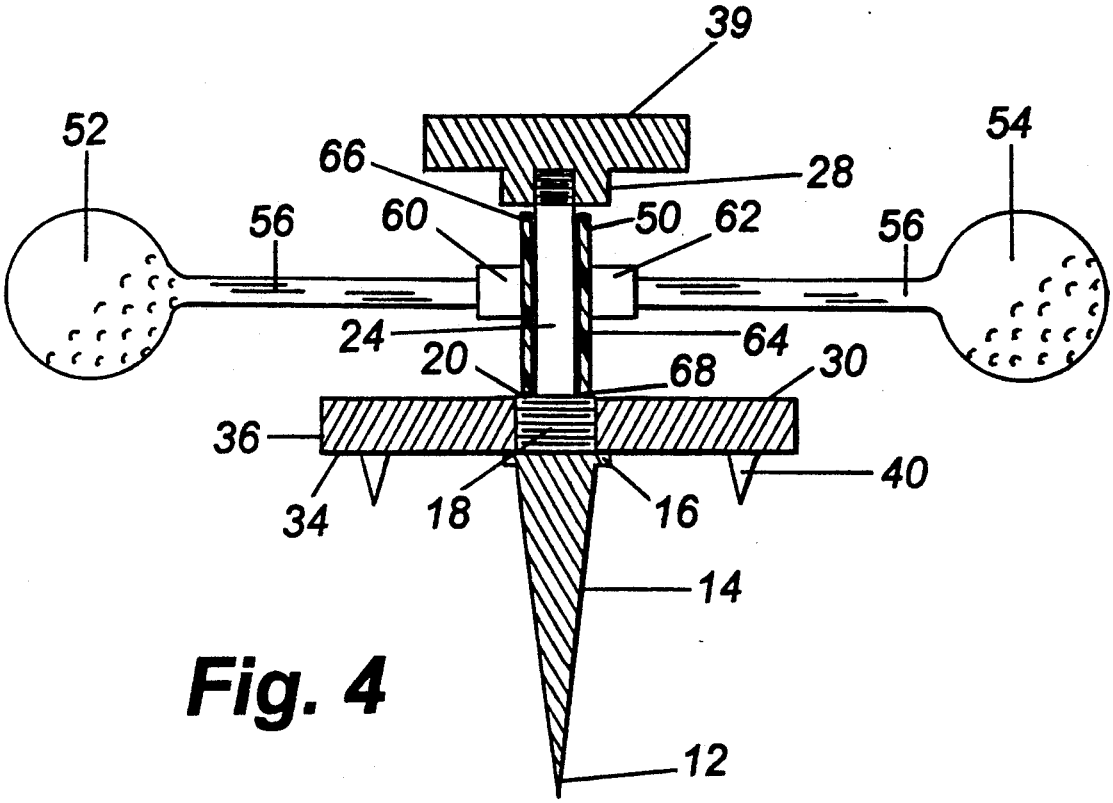
FIG. 4 is a vertical cross section view taken along the line of 4 to 4 in FIG. 3.
Figure 5:
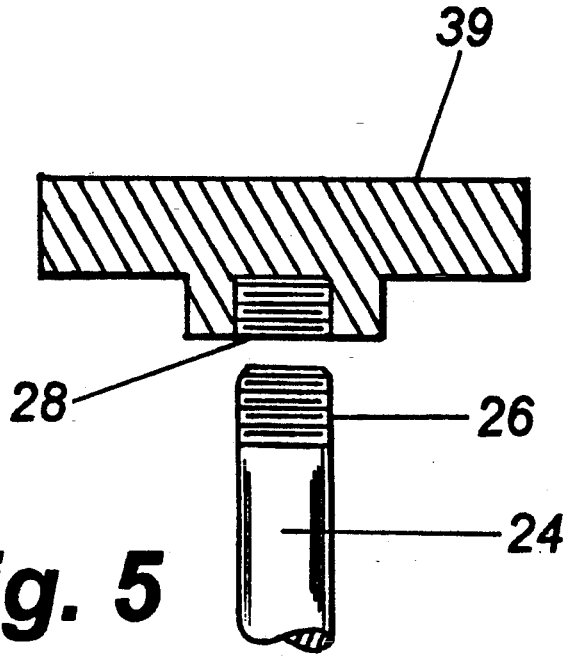
FIG. 5 is a vertical cross section view taken along the center of the cap 39 in FIG. 4.

The rotor verticle cavity lower shoulder 68 rests on the shoulder of the shank 20 as shown in FIG. 4.

The spindel upper most end 26 is machine threaded to adapt to the circular turn knob cap 39 which has in its lower surface a cylindrical threaded cavity 28 adapted to accept the threaded spindel 26. The circular knob cap 39 retains the rotor hub 50 on the spindel during the rotation.

To adjust the height of the ball from the ground, the rotor hub 50 is removed from the spindel, rotated through an arc of 180 degrees about its longitudinal axis i.e., turned upside down, and the rotor 50 is again replaced on the center spindel 24. The rotor hub verticle cavity is a variable length whereby the longer portion 64 will provide a raised elevation of the golf like ball, and, the shorter portion 66 will provide a lower elevation of the golf like ball in relation to the ground.

My improved golf practice device provides great portability and can be assembled or disassembled simply and easily just by screwing the verticle center pin into the base and placing the rotor hub on to the spindel, capping the spindel with the turn knob, and the improved golf device is prepared to be placed into the ground.

My improved golf practice device 10 may be easily and readily mounted in the ground or other similar surface. Initially, the center pin 14 is pressed into the ground so the upper base portion 32 thereof projects above the ground.

As noted above, all of the components of the improved golf practice device 10 can be made from various materials such as from plastic, metal, wood, rubber and the like.

Plastic material of the type which can be readily molded could be the best suggested use. Among many varities, one such plastic material is polyethylene.

From the foregoing it should be apparent to those having skill in this art that my improved golf practice device affords a novel means buy which a golfer may practice both tee and fairway type shots. The improved device 10 may be relatively inexpensively manufactured because substantially all of its component parts can be of molded plastic construction or other desireable materials. Not only does the use of such molded plastic components decrease the manufacturing costs, but also greatly enhances the appearance of the device, thereby giving the device widespread customer appeal.

It should also be obvious to persons having skill in this art that modifications of changes could be made in the structure or design of my improved golf practice device 10 described hereinabove. In other words, the improved golf practice device 10 disclosed herein may be embodied in other specific forms without departing from the spirit or central characteristics of my invention. Thus the preferred embodiment of my improved golf practice device 10 described herein is therefore to be considered in all respects as illustrative and not restrictive, the scope of my invention being indicated by the appended claims, rather than by the foregoing description, and all changes which come within the meaning and range of equivalency of the claims are therefore intended to be embraced herein:

I claim:

1. An improved golf practice device for permitting right handed and left handed golfers to practice their golf swings in a relatively restricted or confined area, comprising:

A body including a flat, generally circular base which has a centrally threaded aperture an upper surface and a lower surface that is adapted to be in contact with the ground, the body also including a center post which projects upwardly from the upper surface of the base through said threaded aperture and which is disposed so that its central longitudinal axis is substantially coaxial with the center of the base and is substantially perpendicular to the plane of the lower surface of the base; the base under surface having a plurality of evenly spaced minature ground pegs disposed about its periphery adapted to be placed into the ground and which is utilized to secure the body to the ground; the center post comprising a first cylindrical portion encompassing a threaded cylindrical shank adapted to be threaded into said threaded aperture and a second smaller diameter cylindrical portion connected integrally thereto, the second cylindrical portion being adjacent to the upper surface of the base, and a third lower portion connected integrally containing a plurality of vertical blades diametrically opposed and contoured to merge into a point toward its lowest end, and thereof, becoming a ground spike which can be easily pressed into the ground by hand encompassing the complete golf device firmly on the ground and which is utilized to restrain the body from movement with respect to the ground, and, furthermore, the device encompasses a central cylindrical rotor having a verticle cavitiy which rotates horizontally on its vertical axis with a lower shoulder thereof resting on the top surface of the threaded shank and with opposed cylindrical horizontal cavities having a radial longitudinal axis perpendicular to said vertical axis and attached to each horizontal cavity are horizontal spokes that have attached to each outer end thereof a golf ball, each ball being spaced equally apart from the vertical axis of the center spindel whereby when a golf ball is struck by a golf club the rotor rotates about its central axis, the rotor being retained on the center spindel by means of a circular cap screwed to the uppermost end of the second smaller diameter cylindrical portion, and upon the completion of the rotation of the revolving balls, the rotating balls cease to rotate by the forces of gravity and come to a stop at a numeral provided on the top surface of the base reflecting a suggested guide to the activity performed.

2. The improved device described in claim 1 wherein said second portion protects upward from the center of the circular base as an integral part of said first portion with its lowest portion integrally connected to the cylindrical portion of the first portion whose cylindrical portion upper surface is a smooth and includes a flat shoulder with the outside cylindrical walls threaded adapted to be screwed into the center cavity of the circular base where it is firmly held together by screwing the cylindrical threaded shank into the base center cavity and having a cylindrical shoulder flange shoulder at the base of the threaded portion which is made flush with the lower surface of the circular base and the third portion integrally connected below the threaded shank comprising of verticle blades diametrically opposed and contoured into a formed point toward the lowest end of the of the third portion becoming a pointed ground spike.

3. The improved device described in claim 1 wherein the rotor hub contains a through verticle cavity which is mounted on the center post and rests on the threaded top surface of the shank and rotating horizontally on its verticle axis and the cylindrical horizontal cavity rotating horizontally on the radial longitudinal axis perpendicular to the central axis and having attached to each horizontal cavity is singular spokes whose ends are attached to golf balls with each ball being spaced equally apart from the vertical axis of the center spindel having the golf ball being struck by a golf club said ball rotating horizontally about its central axis.

4. The improved device described in claim 1 wherein the center post uppermost end is machine threaded and adapted to fit a circular turn knob cap from whose under surface projects a cylindrical threaded cavity adapted to be connected to said end for the circular cap to retain the rotor on to the spindel while the rotor rotates freely about the center spindel.

5. The improved device described in claim 1 whereby the circular base encompasses a generally circular row of numerals spaced radially inwardly from the peripheral edge of the base with the numerals reflecting a reference point of which may be used as a guide.

* * * * *